US011536526B2

(12) United States Patent
Mirzoev

(10) Patent No.: US 11,536,526 B2
(45) Date of Patent: Dec. 27, 2022

(54) AUTOMATIC WEAPON SYSTEM

(71) Applicant: Rustam G. Mirzoev, Novosibirsk (RU)

(72) Inventor: Rustam G. Mirzoev, Novosibirsk (RU)

( * ) Notice: Subject to any disclaimer, the term of this patent is extended or adjusted under 35 U.S.C. 154(b) by 0 days.

(21) Appl. No.: 17/470,945

(22) Filed: Sep. 9, 2021

(65) Prior Publication Data

US 2021/0404755 A1 Dec. 30, 2021

Related U.S. Application Data

(63) Continuation-in-part of application No. PCT/RU2020/000112, filed on Mar. 2, 2020.

(30) Foreign Application Priority Data

Mar. 11, 2019 (RU) ..... RU2019106869

(51) Int. Cl.
*F41A 3/88* (2006.01)
*F41A 5/18* (2006.01)
*F41A 5/34* (2006.01)

(52) U.S. Cl.
CPC ..... *F41A 3/88* (2013.01); *F41A 5/18* (2013.01); *F41A 5/34* (2013.01)

(58) Field of Classification Search
CPC ..... F41A 3/12; F41A 3/88; F41A 5/18; F41A 5/30; F41A 5/32; F41A 5/34
USPC ..... 42/5, 14, 15, 16; 89/180
See application file for complete search history.

(56) References Cited

U.S. PATENT DOCUMENTS 3,261,264 A * 7/1966 Wilson ..... F41A 3/62 89/193
4,015,512 A * 4/1977 Feerick ..... F41A 3/40 89/190
4,977,815 A * 12/1990 Stephens ..... F41A 21/28 89/14.3

(Continued)

FOREIGN PATENT DOCUMENTS

EP 1338857 A2 * 8/2003 ..... F41A 3/62

OTHER PUBLICATIONS

International Search Report in corresponding International Application No. PCT/RU2020/000112.

*Primary Examiner* — Bret Hayes
(74) *Attorney, Agent, or Firm* — Lawrence G. Fridman, ESQ; Feigin & Fridman, LLC

(57) ABSTRACT

An automatic weapon system including a gas evacuation opening formed in a bore of a barrel, a gas evacuation chamber, a barrel immobilizing device, a slide, a weapon frame with guides for guiding slide movement, a return spring mechanism of the slide and the breech. The gas evacuation chamber is disposed at a near-bore space located at the barrel bore outlet, a front wall of the chamber located at the barrel bore outlet is attached at the barrel outlet and having a lower part resting on a weapon frame. A rear wall of the chamber is formed by at least one bridge assembly having one end attached to the slide and another end sliding along the barrel, the bridge assembly is formed by a substantially flat plate having a groove extending from the barrel to the frame and sliding along the barrel, at least one sealing gasket. The frame of the weapon serves as the lower part of the evacuation chamber, the slide serves as upper and side walls of the chamber, a downwardly directed ledge provided at the front of the slide.

6 Claims, 6 Drawing Sheets

(56) References Cited

U.S. PATENT DOCUMENTS

| | | | | |
|---|---|---|---|---|
| 5,955,696 | A * | 9/1999 | Meller | F41A 3/82<br>89/196 |
| 2012/0048104 | A1* | 3/2012 | Bryant | F41A 19/37<br>42/69.01 |
| 2012/0137871 | A1* | 6/2012 | O'Brien | F41A 5/18<br>89/191.02 |

* cited by examiner

AUTOMATIC WEAPON SYSTEM

CROSS-REFERENCE TO RELATED APPLICATIONS

This application is continuation-in-part application of PCT Application PCT/RU2020/000112 having international filing date Mar. 2, 2020, claiming priority of Russian Patent Application S.N. 2019106869 filed Mar. 11, 2019 the disclosure of which applications is hereby incorporated by reference in their entirety.

FIELD OF THE INVENTION

The invention relates to the field of automatic weapon systems, and more specifically it relates to automatic weapons with the diversion of propellant gases for reloading through an opening in the barrel bore.

BACKGROUND OF THE INVENTION

Currently, there are known systems that use the energy of the propellant gases formed when firing to recharge. Consequently, the use of the diversion of part of the gas through the opening in the barrel, combined with the change in the structure of the slide and the gas chamber makes it possible to regulate the speed and impact force of a bullet, as well as the rate of fire.

Russian Federation Patent No. 2347169 issued to V. A. Kaminsky for Automatic pistol discloses automatic weapon—a pistol that contains a stationary barrel, a slide with a drummer and ejector, a frame, a spring-loaded gas engine with a gas piston and a gas chamber, a firing mechanism, and a magazine. An essential feature of this patent is that the stationary barrel is equipped with a shank located at the lower part of the breechblock, the slide is designed to ensure that its front part is skewed down in the extreme forward position. At the same time at the front of the slide from the sides are mounted combat protrusions, and their responsive combat stops are located in the grooves provided at the tail of the stationary barrel, the gas piston is made with a window for the ejection of the casing and the ability to disengage and move the slide back when moving backward, and when moving the slide forward and ensure that its front part is skewed downwards, while the gas chamber installed to coverage the muzzle of the stationary barrel having the gas outlet channels located along its circumference.

Russian Federation Patent No. 2464518 issued to Reshniak for Beaver submachine gun teaches automatic small arms, having the automation which is based on the principle of diverting propellant gases into a gas chamber, containing a barrel with a chamber, a gas outlet channel with a cylinder in which a piston is located; a barrel box rigidly fastened to the barrel, a frame with a slide, having a rigid fixation, a single and automatic trigger mechanism, a cartridge magazine made with the possibility of insertion into a pistol grip. An essential feature of this patent is that the barrel has a combined channel consisting of accelerating, combat and stabilizing parts, a reclusive-rig frame on which from the side of the slide members are provided locking the slide on the lugs along the axis from the outside of the slide and to move the slide in the receiver along the guides, and to rotate the slide along the axis when locking, with the possibility of using cartridges of different lengths and for reverse rotation when unlocking the slide, while the firing mechanism is made of a striker type, and double-row cartridge magazines are attached to the pistol grip shaft hatch.

Both the above discussed weapons utilize at the base of the automatic reloading system utilize a gas engine, including a closed gas chamber with piston and rod, this complicates the kinematic and constructive recharge scheme, and accordingly reduces the reliability of the product in operation and convenience of maintenance.

Another pertinent prior art know to the applicant also discloses an automatic weapon system. This weapon system uses the removal of part of the propellant gases from the barrel bore through a special hole in the barrel bore for powering the automatic gas engine, including a barrel with a through hole for gas outlet, a gas outlet chamber with a piston and a rod, a device for immobilizing the barrel, a slide, a weapon frame with guides of the slide movement, the return spring mechanism of the slide and the breechblock (see glushiteli-zvuka-vystrela-dlya-avtomaticheskogo-oruzhiya/49-1-4-mekhanizmy-avtomatiki-strelkovogo-oruzhiya). The disadvantages of this weapon system are in the large recoil force, a strong upward movement of the barrel and significant shock impulses, which lead to a decrease in firing accuracy. In addition, the complexity of the gas engine design leads to a decrease in reliability and service life.

SUMMARY OF THE INVENTION

As to one aspect of the invention the system is provided a gas evacuation chamber which opens at the shot to divert the gases. The chamber is formed within a near-barrel space located at the outlet of the of the barrel bore. A front wall of the chamber is disposed where the barrel bore outlet and has the bottom part which rests on the frame of the weapon. The opposite rear wall of the chamber is formed, by at least one bridge assembly having a top area attached to the slide. The bridge assembly includes at least one substantially flat plate with a groove extending from the slide to the frame and also including at least one sealing gasket sliding on the barrel. A unitary frame of the weapon serves as a bottom part of the chamber. Parts of the slide functioning as top and side walls of the chamber.

As to another aspect of the invention a slide return spring mechanism returns the slide to the original front position, and a special mechanism is provided for pressing the slide to the frame of the weapon.

As to still another aspect of the invention guides having channels are provided to coordinate movement of the slide backward and forward. The channels are formed on both sides of the weapon frame. Each channel at the barrel bore outlet is provided with downwardly directed ledge adapted to secure the slide in the front position. In order to fasten the slide on the frame of the weapon and to facilitate the direction of its movement, at the bottom of the side walls of the slide at its front region there are provided fixing lugs on the frame of the weapon in the form corresponding to the downwardly oriented ledge Sliding lugs having streamlined shape are disposed on at the of the breechblock region.

BRIEF DESCRIPTION OF THE DRAWINGS

The subject matter regarded as the invention is particularly pointed out and distinctly claimed in the concluding portion of the specification. The invention, however, may best be understood by reference to the following detailed description when read with the accompanying drawings in which:

GENERAL DESCRIPTION OF THE INVENTED TECHNOLOGY

Figure 1:
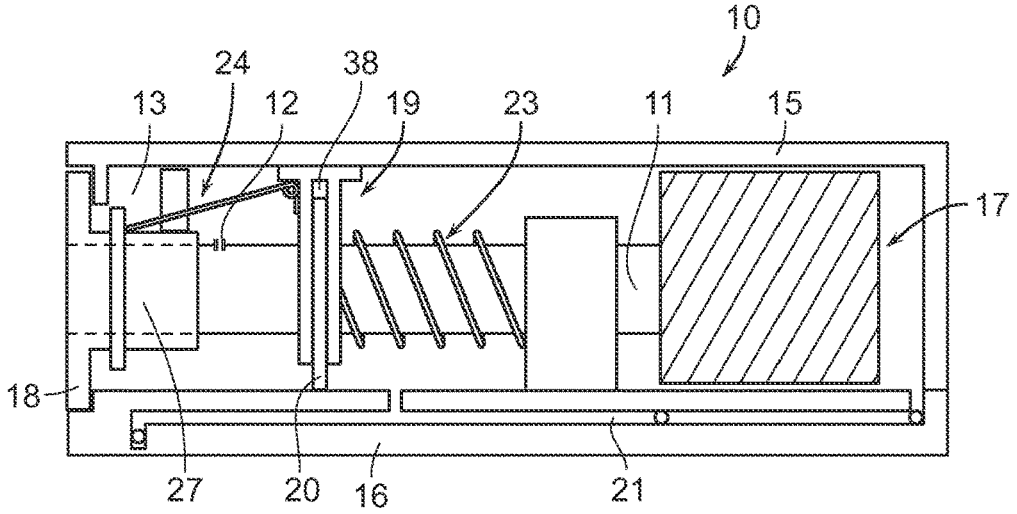
FIG. 1 is a diagram of the system of the invention showing the initial slide position.

The terms "about" and "essentially" mean.+−.10 percent. The terms "a" or "an", as used herein, are defined as one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination.

As to general features of the system of the invention FIGS. 1-8 illustrate an exemplary firearm 10 that includes a barrel that is positioned within a slide. The slide houses a receiver that includes a firing pin assembly and is attached to one end of the barrel. The slide is mounted to a frame that may include a grip and a trigger assembly. In operation of the firearm system 10 the trigger assembly is pulled to cause the firing pin to fire the cartridge which is then propelled down the barrel by compressed gasses. The force of firearm causes the slide to retract to cock the firing pin and also induces the barrel to receive a new cartridge.

The slide is movably arranged on the frame in the longitudinal direction, that is, in the direction along the length of the barrel. The frame may serve to hold the mechanical parts of the firearm, such as the trigger housing and slide carrier group. The frame provides support for the control and guide movement elements for the slide.

The slide is the part of the weapon that moves during the operating cycle. A slide is a mechanical part of a firearm that blocks the rear of the chamber while the propellant burns, but moves out of the way to allow another cartridge or shell to be inserted in the chamber.

The slide cycles back and forward between each shot. When it moves back, an extractor pulls the spent casing from the chamber. When it moves forward, it strips a cartridge from the magazine and pushes it into the chamber. Once the cartridge case is clear of the chamber, the ejector kicks the case out of the weapon. The slide may be spring-loaded so that once it has moved to its rearmost position in the firing cycle, spring tension brings it back to the starting position chambering a fresh cartridge during the motion, provided that the magazine is not empty.

DETAILED DESCRIPTION OF THE EMBODIMENTS OF THE INVENTION

While this invention is susceptible to embodiment in many different forms, there is shown in the drawings and described in detail specific embodiments, with the understanding that the present disclosure of such embodiments is to be considered as an example of the principles and not intended to limit the invention to the specific embodiments shown and described. In the description below, like reference numerals, if any, are used to describe the same, similar, or corresponding parts in the several views of the drawings. This detailed description defines the meaning of the terms used herein and specifically describes embodiments in order for those skilled in the art to practice the invention.

Among essential elements of the system of the invention are as follows:

10—the system of the invention;
11—a barrel,
12—a through opening for evacuation of gases,
13—a gas evacuation chamber,
14—a device for immobilizing the barrel,
15—a slide,
16—a frame of the weapon,
17—a breechblock,
18—a wall of the chamber, located at the barrel bore exit,
19—a bridge assembly with a groove connected to the slide and sliding along the barrel,
20—a sealing gasket sliding along the barrel,
21—guides formed within side walls of the frame of the weapon,
22—a downwardly directed ledge of the guides,
23—a mechanism for returning the slide to the original, front position,
24—a mechanism for pressing the slide to the frame of the weapon,
25—lugs fixing the slide on the frame of the weapon,
26—lugs having streamlined configuration,
27 a fastening coupling,
28—a protrusion at the front of the slide, directed downwards, downwardly directed ledge at the front of the slide.
29—grooves extending upwardly from the guides facilitating disassembly of the slide.

30—a spring-loaded lugs for retaining the slide in operational/working mode and upon being pressed allowing removal of the slide.

The invention provides an automatic weapon system 10 utilizing removal or diversion of a part of the propellant gases through a gas evacuation opening 12 formed in the bore of the barre 11. As illustrated in FIGS. 1-8 among essential elements of the firearm system 10 of the invention are: a barrel 11 having a bore 32 extending therethrough, a gas evacuation opening 12 formed in the bore 32 of the barrel, a gas evacuation chamber 13, a device for immobilizing the barrel 14, a slide 15, a frame 16 and breechblock 17 of the weapon. The gas evacuation chamber 13 is located at the front outlet 31 region of the barrel and is separated from the surrounding space by walls.

A fastening coupling 27 having a front wall 18 is provided to facilitate connection of the barrel 11 to the frame 16 at the barrel bore outlet 31. Downwardly directed ledge 28, which can be in the form of a plate, is provided at an upper wall 33 of the front area of a slide 15. An opening 34 is provided in a central part of the fastening coupling 27 to accommodate a front region of the barrel including the barrel bore outlet 31. The coupling and the barrel are supported by the frame 16 of the weapon.

Figure 4:
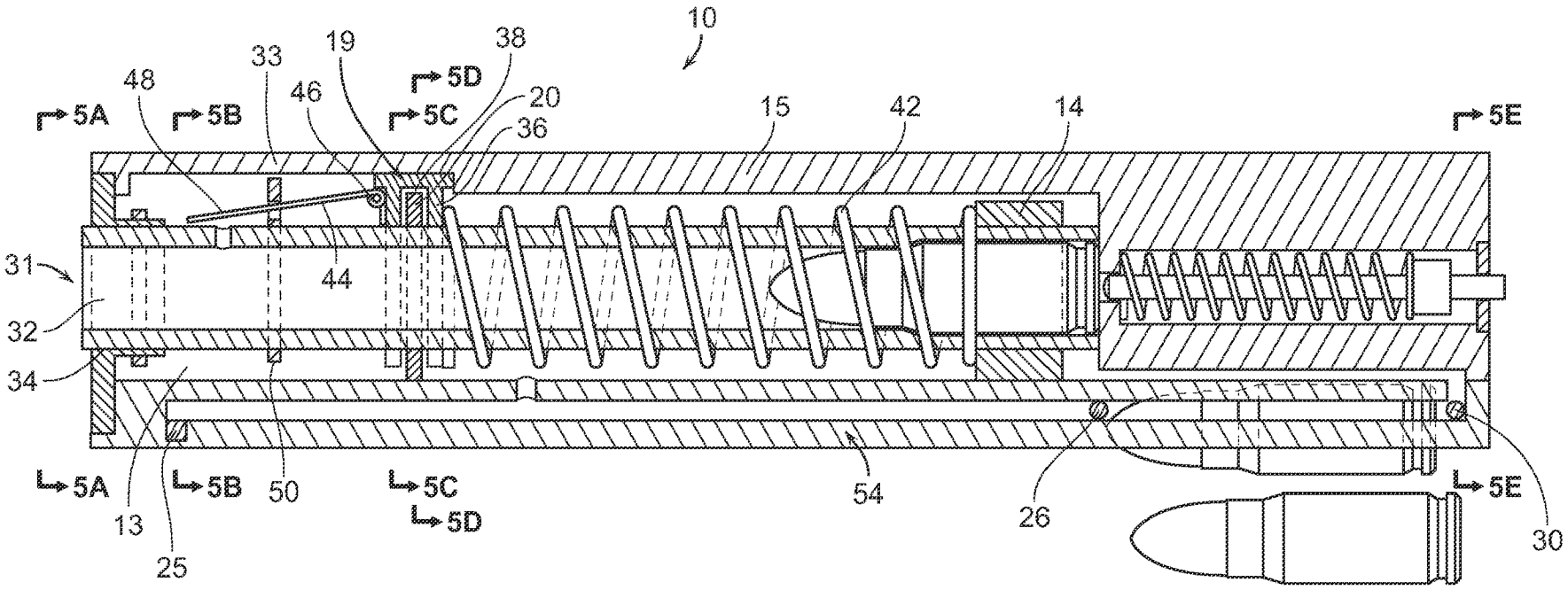
FIG. 4 is a diagram showing the system of the invention showing the initial slide position in greater detail.
Figure 5A:
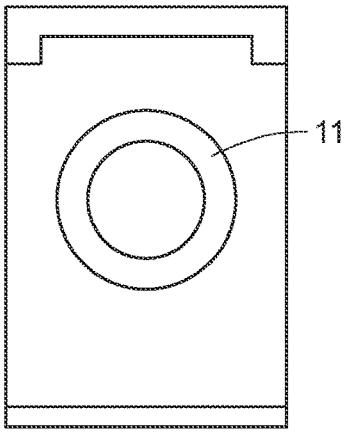
FIG. 5A is a view according to section line 5A-5A of FIG. 4.
Figure 5B:
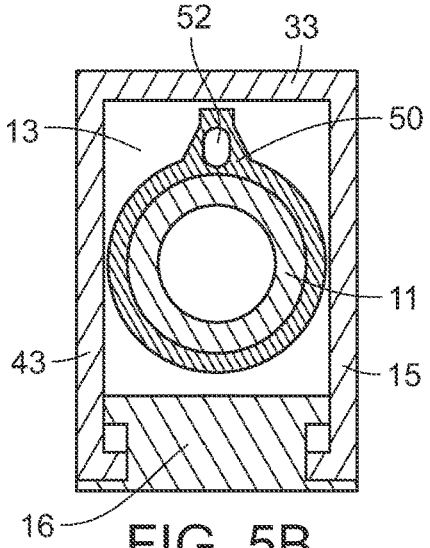
FIG. 5B is a view according to section line 5B-5B of FIG. 4.
Figure 5C:
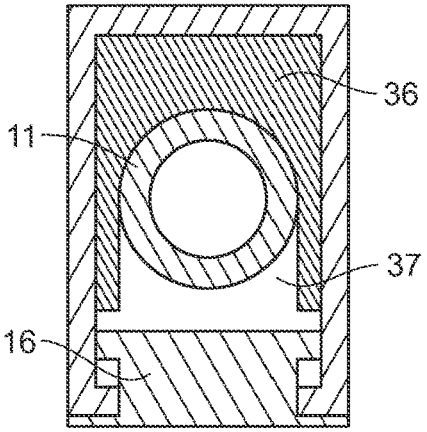
FIG. 5C is a view according to section line 5C-5C of FIG. 4.

At the barrel outlet 31 a front part of the gas evacuation chamber 13 is formed by a front wall 18 of the fastening coupling 27. In the illustrated embodiment a rear part of the chamber 13 is formed by a bridge assembly 19 consisting of two members 36 spaced from each other by a gap 38. A sealing pad or gasket 20 tightly disposed within the gap 38 is provided for slidable motion along the barrel. A top part of the bridge assembly 19 is attached to an inner part of the upper wall 33 of the slide, whereas central and bottom parts of the bridge move or slide along the barrel 11. As best illustrated in FIGS. 4, 5B and 5C a solid frame 16 of the weapon serves as a lower part of the chamber 13. Top and side walls of the chamber 13 are formed by the corresponding top 33 and side 43 walls of the slide 15, which in cross-section have a U-shaped configuration.

As illustrated in FIGS. 1 and 4, in the initial condition, the front wall 18 of the evacuation chamber 13 hermetically isolates a near-barrel space located at the barrel bore outlet 31 from outside environment. The front wall 18, being a part of the coupling 17, is formed with an opening 34 to accommodate the barrel outlet region 31. A lower part of the front wall 18 rests in a recess provided at the front region of the weapon frame 16. The integral frame 16 of the weapon serves as a bottom wall of the chamber 13.

Figure 5D:
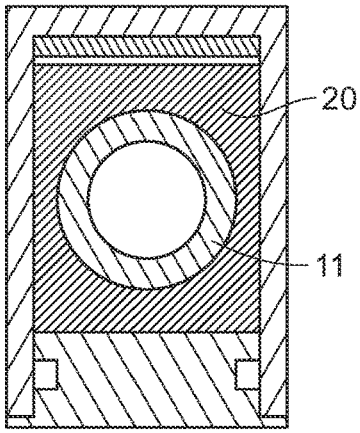
FIG. 5D is a view according to section line 5D-5D of FIG. 4.
Figure 5E:
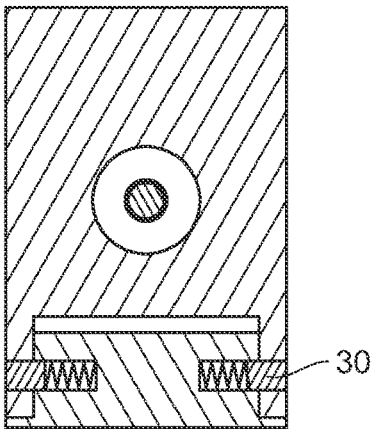
FIG. 5E is a view according to section line 5E-5E of FIG. 4.

Tightness of a rear part of the evacuation chamber 13 facing the immobilizing device 14 is facilitated by the bridge assembly 19 having the sealing gasket 20 freely slidable along the barrel and extending to the frame 16 (see FIGS. 1, 4 and 5D). The bridge assembly 19 extends between the slide 15 and the frame 16 through operation of the system of the invention.

The members 36 of the bridge assembly 19 are typically in the form of substantially flat plates arranged parallel to each other and disposed transversely with respect to the top wall 33 of the slide. The members 36 are similar to each other, and each is formed with a groove 37 open from the bottom (see FIG. 5C) and directed downwardly from the top level of the barrel 11 to the frame 16. The open bottom of the groove 27 allows the slide 15 to be displaced in the upward direction during operation of the invention (see FIGS. 2, 3, 7 and 8).

In the preferred embodiment the bridge assembly 9 consists of two members/plates 36 with a single sealing gasket 20 interposed within the gap 38. The tight connection between the gasket 20 and the bridge members 36 is assured by a compression spring 42 of the return spring mechanism 23.

In an embodiment in which the bridge assembly 9 is formed with multiple members/plates 36, additional sealing gaskets are placed between each pair of the adjacent members. Such gaskets can be additional to the gasket facing the immobilizing device 14. When the bridge assembly 19 is formed by a single member/plate 26, a sealing gasket 20 can be attached to its surface facing the immobilizing device 14.

The above-discussed bridge assembly 19 including the respective sealing gaskets 20 form a sealed wall that isolates the rear part of the gas evacuation chamber 13 facing the immobilizing device 14.

Figure 6:
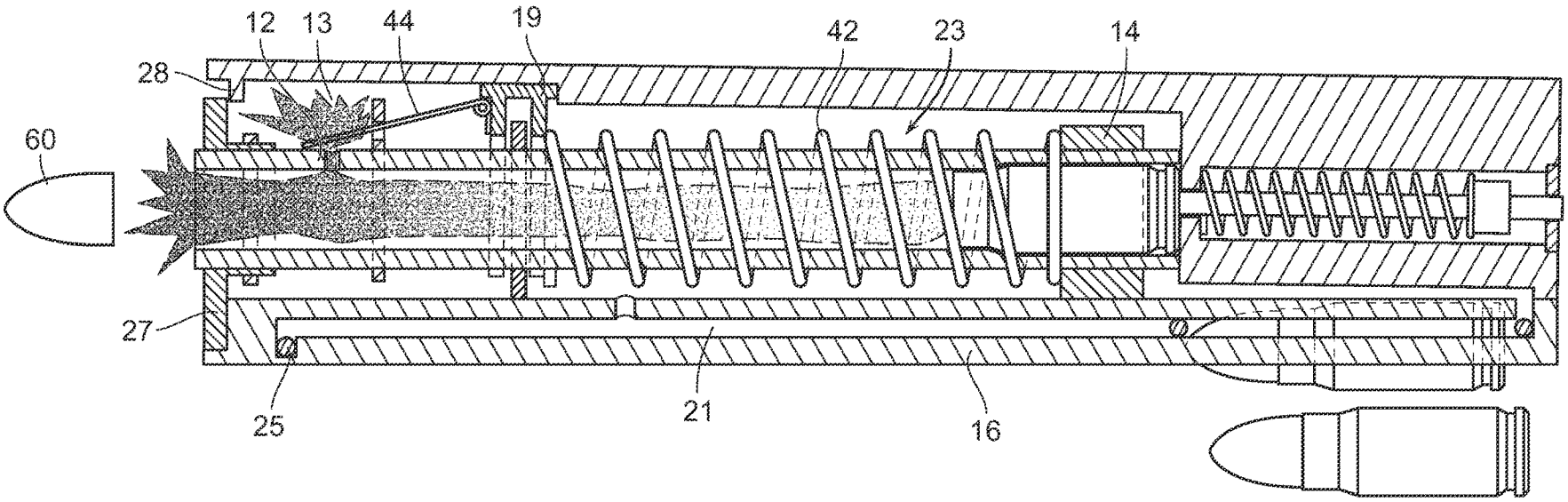
FIG. 6 is a diagram showing the system of the invention at the time when shot is fired in greater detail.

In the evacuation chamber 13 within the wall of the barrel bore 32 facing an upper wall 33 of the slide the through gas evacuation opening 12 is provided to evacuate a part of the propellant gases. As best illustrated in FIG. 6, such evacuation occurs after the bullet passes through an area of the barrel bore area having the opening 12. The position and diameter of the gas evacuation opening 12 can affect the delay and force of the slide rollback, and also affects the characteristics of the accuracy of the shooting, the power of the bullet and the force of recoil.

It will be discussed later in the application that when the propellant gases are ejected through the gas evacuation opening 12, an excess pressure is created in the chamber 13, causing depressurization of the chamber along the boundaries of contact of the chamber walls. This occurs while the slide 15 is displaced up and back, as illustrated in at least FIGS. 2 and 6.

To return the slide 15 to its initial position after a shot is fired, the return mechanism 23 is provided, which is located between the immobilizing device 14 and the bridge assembly 19. The mechanism 23 is typically consists of a helical compression return spring 42 which is located under the slide 15 surrounding the barrel 11 in the space between the device 14 and the bridge assembly 19 having the sealing gaskets 20.

Although in the illustrated embodiment the mechanism 23 is illustrated with a single spring 42. In an alternate embodiment, the return mechanism 23 can be in the form of at least two helical compression springs, which are fixed along the axis of the barrel in the space between the barrel immobilizing device 14 and the bridge assembly 19. These springs can be placed within suitable guides, for example in special grooves in the frame or in guides of the frame.

The slide 15 is pressed against the weapon frame 16 utilizing a mechanism 24. The mechanism 24 consists of at least one bending spring 44 fixed at a proximal end 46 to the area of attachment of the bridge 19 to the slide 15. A distal end 48 is movably connected or mated within a support 50 located along the barrel having a guide groove or channel 52 (see at least FIGS. 4, 5B,6).

The spring 44 is movably retained within the guide channel or groove 52 throughout the combat stroke of the slide (see FIGS. 1, 2, 4 and 6). Various designs of the guide channel or groove 52 are within the scope of the invention. Although FIGS. 1, 4, 5B show the mechanism 24 having the single spring 44, use of multiple bending springs symmetrically located relative to the barrel 11 to provide proper pressure on the slide is also contemplated.

As to an alternate embodiment, it is also possible to press the slide 15 to the weapon frame 16 by means of at least one helical tension spring attached at one end on the upper part of the slide or to the upper part of the bridge 19, whereas the other end is attached the barrel 11 or frame 16 of the weapon in the area of the barrel bore outlet.

Another alternate embodiment of the pressing mechanism 24 may include two helical tension springs located on opposite sides of the barrel and fixed to the barrel or frame of the weapon in the area of the exit of the barrel bore. The other side is fixed to the upper part of the slide in the area adjacent to the bridge attachment to the slide. Leaf springs located in the channels above the lugs can also be used as a pressing mechanism.

A downwardly directed protrusion 28, which can be in the form of a plate, is positioned at the upper wall 33 at the front part of the slide 15. The protrusion 28 provides a delay in the release of pressure in the chamber 13. By changing the width of the protrusion 28, it is possible to regulate the beginning of the slide rollback and other essential characteristics of the invention. Typically, the width of the protrusion 28 is greater than the height of the fixation lugs and typically is within the range 4-16 mm.

The guides 54 having channels 21 are provided to coordinate movement of the slide 15 backward and forward. The channels 21 are formed on both sides of the weapon frame 16, with their length corresponding to the backward movement of the slide. Extension of the channels 21 can be provided for removing the slide 15 during disassembly of the weapon. The guide channels 21 are typically in the form of grooves open on one side facing exterior of the frame. The cross-sectional shape of the channels varies, but typically it has a rectangular configuration. In each guide channel 21 at the barrel bore outlet region 31, a downwardly directed ledge 22 is formed. At the bottom of the side walls of the slide at its front region, lugs 25 are provided configured to match the shape of the corresponding ledges 22 in the channels 21. This arrangement assures a reliable fixation of the corresponding lugs 25 provided on the slide. The ledges 22 are directed downwardly relative to the horizontal orientation of the slide on the frame.

Sliding lugs 26 having streamlined shape are disposed at the of the breechblock 17 region. An essential function of the lugs is to fasten the slide on the frame 16 of the weapon and to facilitate the direction of its movement.

The front lugs 25 are provided for fixing the slide and prevent displacement in the initial state of the weapon's operation. The height/lengths of the lugs are preferably between 2 to 6 mm. The transverse fixation of the slide is provided by the pressure mechanism 24 and the frame 16 of the weapon as described above.

An essential function of the front lugs 25 is to retain the slide 15 within the frame of the weapon. In the area of the breechblock 17 streamlined lugs 26 are situated. The lugs are formed to correspond to the configuration of the channels 21 and the ledge 22 and to accommodate the direction of the slide 15 movement at the bottom of the frame side walls.

The rear lugs 26 serve as guides for movement within the channels. The streamlined shape of the lugs 26 facilitates a rotational moment of the slide 15 around an axis of rotation passing through these lugs. In other words, during the rotation lugs 26 allow the front of the slide 15 to be lifted up as shown in FIGS. 2,3 and 6-8. When a shot is fired, an excess pressure is created in the chamber 13 by the gases released through the evacuation opening 12 acting on the upper wall 33 of the slide. As a result, the front lugs 15 are pushed out of the ledges 12 provided in the channels, and the slide 15 moves in the up and backward directions, as shown in FIGS. 2,3, 7 and 8.

Removal of the slide 15 from the frame is carried out by pressing on a spring-loaded lug 30 limiting the active movement of the slide. Then the slide 15 is manually moved further than its active movement and rests on the end part of the guiding channels. Then by movement through the ledge 12 extending upwardly from the channels until the exit from the weapon frame is reached and combined with the position of the grooves of the channels of the slide, the slide is detached from the frame.

Figure 2:
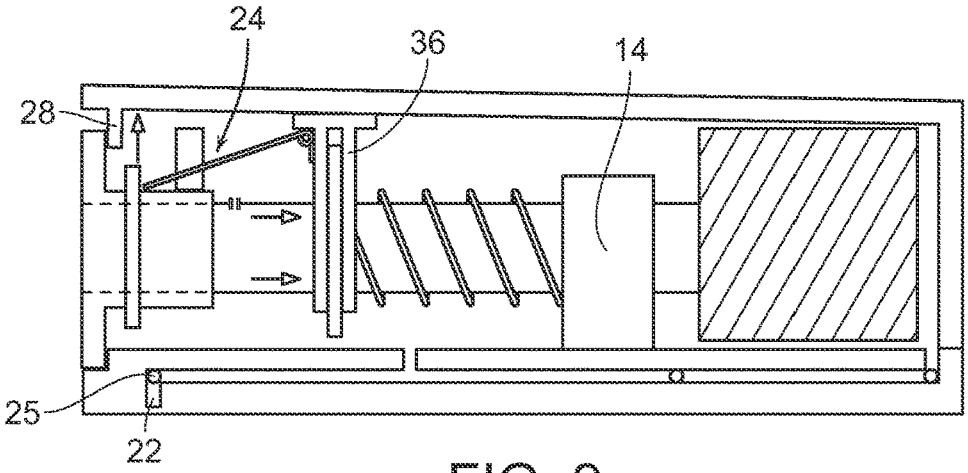
FIG. 2 is the diagram of the system of the invention at the time when shot is fired.

The system 10 of the invention operates in the following manner, as illustrated in FIGS. 1 and 4, in the initial position the slide 15 is disposed at the barrel bore outlet region 31 and the spring 42 of the return mechanism 23 is not deformed. As best illustrated in FIGS. 2 and 6, when fired a bullet 50 passes through the barrel bore 32 beyond the gas evacuation opening 12, and the gases are released through this opening into the space of the gas evacuation chamber 13. The pressure in the chamber 13 increases, and the front region of the slide 15 moves upwardly. As a result, the lugs 25 come out of the engagement with the ledges 22 provided to retain the slide 15 in the forward position (see FIG. 7 for example). When the lugs 25 disengage the ledges 22, due to the pressure of the gases in the still sealed gas evacuation chamber 13 (see FIGS. 2 and 6), the slide 15 moves up. As pressure increases, the front wall 33 of the slide is placed in the raised upward position, and the gas evacuation chamber 13 is unsealed. By inertia the slide 15 moves in the backward direction and reaches the spring-loaded lugs 30 (see FIG. 3) that limit the slide movement.

Figure 8:
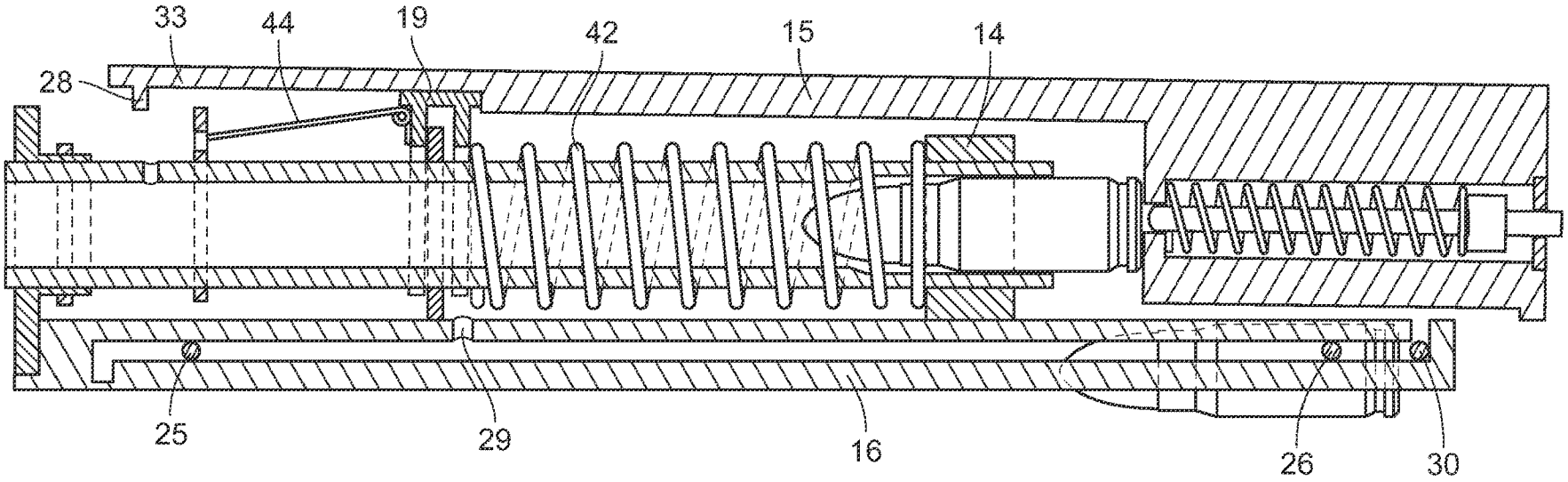
FIG. 8 is a diagram showing another position the system of the invention.

The movement of the front part of the slide 15 upward is facilitated by a streamlined shape of the lugs 26 located at the breechblock 17 area. When the chamber 13 is opened the inside pressure drops to atmospheric and the slide, after stopping in the rear position, returns back, as illustrated in FIG. 8.

In the movement of the slide 15, the action of the pressuring mechanism 24 assures that the slide is pressed against the frame. During the movement of the slide back, in its final stage, a cartridge case is ejected. Upon movement to the initial position, the cartridge is directed into the cartridge chamber (see FIGS. 7 and 8) Thus, when the slide 15 returns to its initial position, the system is again ready to fire.

When the gases through the gas evacuation opening 12 enter the space of evacuation chamber 3. Due to the action of gases on the slide 5, the front part of the slide at the wall 33 rises up. As to the guiding channels 21, the front lugs 25 come out of the engagement with the fixing ledge 22, and the slide is disengaged from the frame and rolled back. Simultaneously the front part of the slide 15 is raised by approximately 4-16 mm. When the slide 15 returns to its initial state, the weapon is reloaded, and it is ready to fire again.

Figure 3:
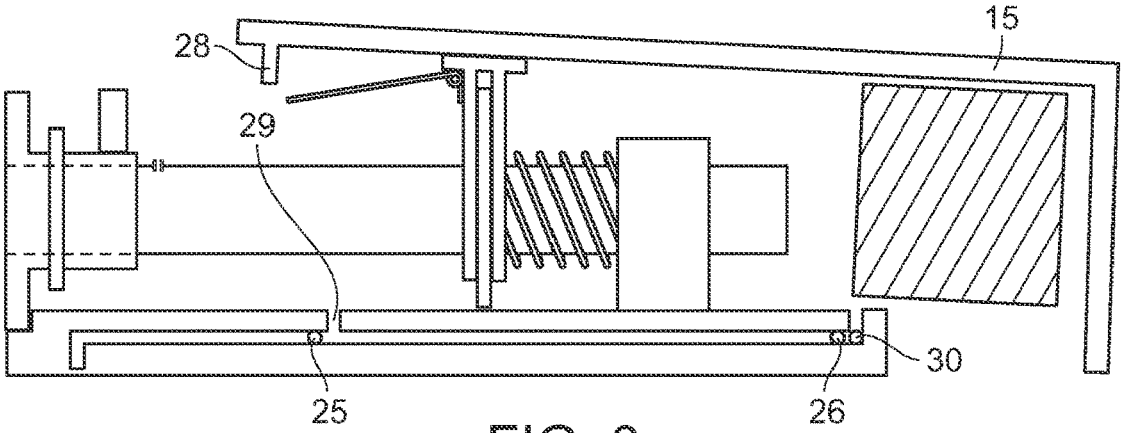
FIG. 3 is a diagram of the system of the invention with the slide in the retracted position.
Figure 7:
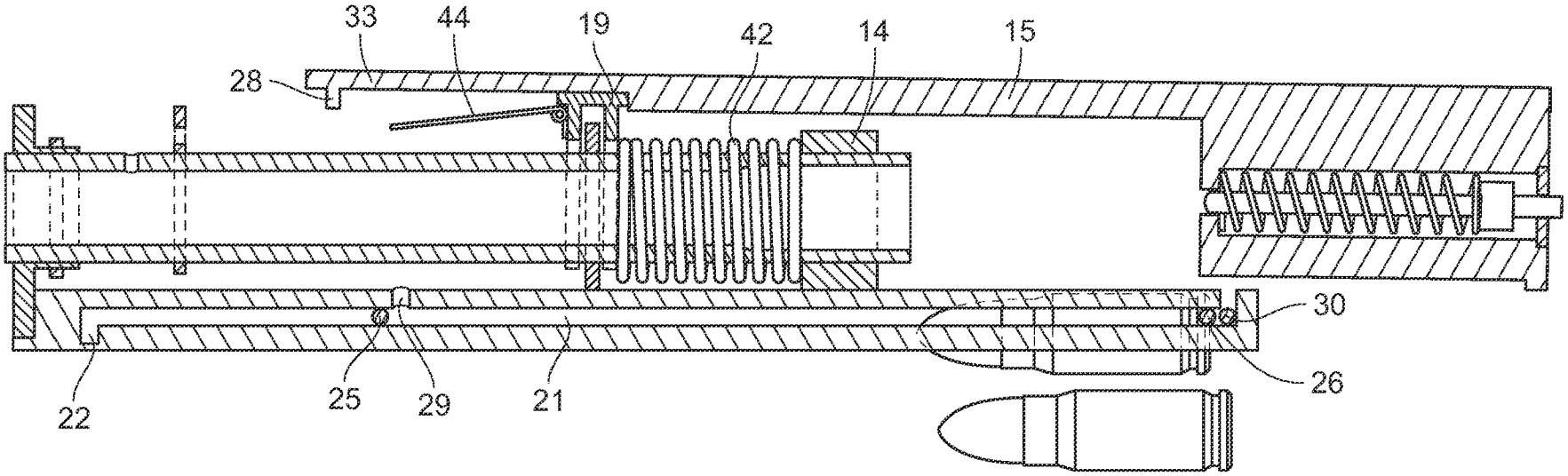
FIG. 7 is a diagram showing the system of the invention similar to that of FIG. 3 in greater detail.

As illustrated in FIGS. 3 and 7, during the shooting, the spring 42 under the action of the backwardly moving slide 15 is compressed, and after the shot it returns the slide forward to its original position as shown in FIG. 1.

To carry out the disassembly of the system of the invention, the extension of the channels beyond of the length of the action is used for its removal. Removal of the slide 15 is carried out by pressing inwardly the spring-loaded lugs 30, limiting the movement of the slide. As a result, the slide is manually moved further than the combat stroke and rests against the end of the guiding channels. Then it moves along the grooves passing from the channels vertically upward to the exit from the weapon frame 16 and to be aligned with the position of the guide groves 29. As a result, the slide is separated from the frame 16 of the weapon.

It has been discussed above that among the essential features of the system of the invention are the following components.

The automatic weapon system 10 of the invention includes the mechanism 23 for returning the slide 15 to the original, front position comprising the compression spring 42 surrounding the barrel and located between the device 14 for immobilizing the barrel and the bridge assembly 19 sliding on the barrel and provided with the sealing gasket 20.

An alternate embodiment of the automatic weapon system 10 of the invention includes the mechanism for returning the slide to the original front position comprising at least two compression springs, disposed along the axis of the barrel in the space between the device 14 for immobilizing the barrel and sliding on the barrel bridge assembly 19.

The automatic weapon system 10 also includes the mechanism 24 for pressing the slide to the frame 16 of the weapon which is formed by at least one bending spring 44 having one end connected to the area of attaching the bridge 19 to the slide, whereas the other end is movably disposed with the guide channel 52 provided in a support 50 placed along the barrel.

In a more specific embodiment the mechanism 24 of pressing the slide 15 to the frame 16 is in the form of at least one stretching spring attached at its top end to the area of the attachment of the bridge to the slide, whereas the other lower end of the spring is connected to the barrel or the frame of the weapon at the area of the barrel outlet.

The automatic weapon system 10 of the invention includes the bridge sliding on the barrel consisting of at least two substantially flat plates, each having a groove extending from the barrel to the frame, having the sealing pads disposed in the respective gaps.

What is claimed is:

1. An automatic weapon system utilizing evacuation of a part of propellant gases from a barrel bore through a gas evacuation opening formed in a bore of a barrel comprising:

a gas evacuation opening formed in a bore of a barrel for evacuation of propellant gases, a gas diverting/evacuation chamber, a barrel immobilizing device, a slide, a weapon frame with guides for guiding slide movement, a return spring mechanism of the slide and a breech, wherein the gas diverting/evacuation chamber is disposed at a near-bore space located at a barrel bore outlet, a front wall of the diverting/evacuation chamber located at the barrel bore outlet is attached at the barrel outlet and having a lower part resting on a weapon frame, an opposite rear wall of the diverting/evacuation chamber is formed by at least one bridge assembly having one end attached to the slide and another end sliding along the barrel, the bridge assembly formed by at least one substantially flat plate having an inner groove extending from the barrel to the frame and sliding along the barrel, the bridge assembly having at least one sealing gasket, the frame of the weapon serves as a lower part of the diverting/evacuation chamber, the slide serves as upper and side walls of the chamber, a downwardly directed projection provided at a front of the slide, the return spring mechanism of the slide for returning the slide to an original, forward position and a mechanism for pressing the slide to the frame, channels formed inside walls of the weapon frame functioning as guides for moving the slide in a backward direction, a downwardly directed ledge at each said channel at the barrel bore outlet to retain the slide in a front position, whereby, fixation lugs are provided at a bottom of a front area of the side walls for connecting the slide to the frame and to coordinate direction of a respective movement, said fixation lugs having a shape corresponding to a shape of the downwardly directed ledge formed in the channels, and streamlined sliding lugs are provided at a breech region, whereby in an initial, forward position of the slide, connections between the walls of the gas diverting/evacuation chamber are sealed, and when a bullet passes through the barrel bore at the gas evacuation opening formed in the bore of the barrel, the walls of the chamber are unsealed so to open the chamber.

2. The automatic weapon system according to claim 1, wherein the return spring mechanism for returning the slide to the original, forward position is a coil compression spring surrounding the barrel, said spring is located between the barrel immobilizing device and the bridge assembly having the sealing gasket sliding along the barrel.

3. The automatic weapon system according to claim 1, wherein the return spring mechanism for returning the slide to the original forward position includes at least two helical compression springs provided along an axis of the barrel in the space between the immobilizing device and the bridge assembly with the sealing gasket sliding along the barrel.

4. The automatic weapon system according to claim 1, wherein the mechanism for pressing the slide to the weapon frame comprises least one bending spring having one end positioned in an area of attachment of the bridge assembly to the slide, and having another end of the bending spring being movably disposed in a guide groove provided along the barrel.

5. The automatic weapon system according to claim 1, wherein the mechanism for pressing the slide to the weapon frame comprises at least one helical tension spring positioned at one end in the region of the attachment of the bridge assembly to the slide, and at the other end disposed a lower level on the barrel or the frame at the bore outlet.

6. The automatic weapon system according to claim 1, wherein said at least one substantially flat plate of the bridge assembly comprises at least two substantially flat plates separated by a gap with a groove from the barrel to the frame, and having said at least one sealing gasket located within the gap.

* * * * *